United States Patent [19]

Colombo

[11] Patent Number: 4,479,671

[45] Date of Patent: Oct. 30, 1984

[54] TUBULAR DOOR LOCK WITH A CATCH DEVICE

[75] Inventor: Angelo Colombo, Lazzate, Italy

[73] Assignee: Valli & Colombo S.p.A., Italy

[21] Appl. No.: 281,412

[22] Filed: Jul. 8, 1981

[30] Foreign Application Priority Data

Jul. 21, 1980 [IT] Italy ..... 22350/80[U]

[51] Int. Cl.[3] ..... E05C 1/16

[52] U.S. Cl. ..... 292/169.14; 292/150

[58] Field of Search ..... 292/150, 153, 147, 169, 292/347, 169.14

[56] References Cited

U.S. PATENT DOCUMENTS

| | | | |
|---|---|---|---|
| 1,378,622 | 5/1921 | Sarbij | 292/150 |
| 1,386,422 | 8/1921 | Ottinger | 292/150 |
| 3,807,779 | 4/1974 | Enders | 292/147 |
| 3,895,505 | 7/1975 | Wasserfaller | 292/150 |

*Primary Examiner*—Richard E. Moore

*Attorney, Agent, or Firm*—Steinberg & Raskin

[57] ABSTRACT

The invention proposes a tubular door lock of the type comprising essentially an elongated box casing for containing a control slide for the bolt, and provided with a plug which can be controlled from the outside for its positioning into a first inactive position in which said plug does not interfere with the path of said slide, and into a second active position in which said plug interferes with said path, and vice versa.

1 Claim, 4 Drawing Figures

TUBULAR DOOR LOCK WITH A CATCH DEVICE

BACKGROUND OF THE INVENTION

The present utility model relates to a tubular door lock with a catch device, of which the combination and configuration of its parts provide it with special utility characteristics.

Tubular door locks operated by handles are widely used in particular in the United States of America, and as a rule are required to be of relatively small standard dimensions.

Because of the small dimensions, the conventional catch devices mounted on tubular locks are of complicated and costly structure, and this constitutes a considerable drawback.

SUMMARY OF THE INVENTION

The object of the present invention is to provide a tubular door lock with a catch device of reliable and simple construction, so as to substantially reduce costs.

This and further objects of the invention will be apparent to experts of the art from reading the description given hereinafter.

The tubular door lock according to the invention is of the type comprising essentially an elongated box casing for containing a control slide for the bolt, and is essentially characterised by comprising a plug controllable from the outside for its positioning into a first inactive position in which said plug does not interfere with the path of said slide, and into a second active position in which said plug interferes with said path, and vice versa.

BRIEF DESCRIPTION OF PREFERRED EMBODIMENT

The invention is illustrated by way of example in the figures of the single accompanying drawing, in which.

DETAILED DESCRIPTION OF PREFERRED EMBODIMENT

Figure 4:
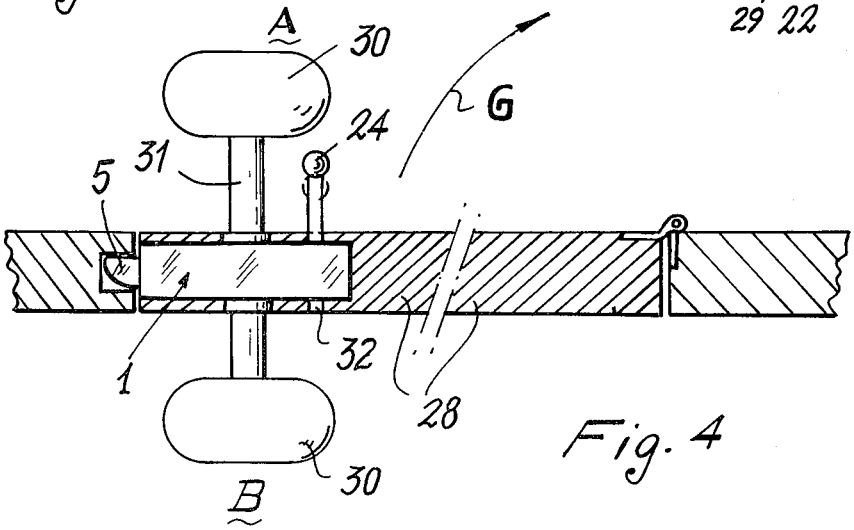
FIG. 4 is a diagrammatic illustration of the lock mounted on a door.

With reference to said figures, the lock—indicated overall by 1—is of the tubular type of standard dimensions for use in the United States of America, and is conventionally constituted by an elongated box casing of rectangular cross-section 2, fixed at one end on to a plate 3 to enable the lock 1 to be mounted in the edge of a door 28 (FIG. 4).

The casing 2 houses a bolt 4 formed from a head 5 with a bevelled face mounted rotatable through 180° on a shank 6 provided with an enlarged end part 7 and engaged by a front wall 8 of a slide 9. Between the head 5 and wall 8 there is disposed a spring 10 for resiliently returning the head 5 into its closure position, illustrated in the figures, when said head is moved from said position by closure of the door without operating the handles.

The front wall 8 of the slide 9 is bounded by two side walls 11, each provided with an aperture 12 and a lug 13 projecting externally from the casing 2 through openings 14 suitably provided in the side walls of said casing.

A transverse element 16 having a width less than the distance between the two side walls 11 is fixed between the base wall of the casing 2 and a closure plate 15 for said casing and is arranged to constitute an opposition element for a spring 17 disposed between said element 16 and the front wall 8 of the slide 9.

In that part of the slide distant from the wall 8 there is mounted a control member operated by opposing handles 30 (FIG. 4) and constituted by a core 18 axially bored to receive the shaft 31 of said handles and provided with an arcuate sector 19, the ends of which, by rotating the core 18 in one direction or the other, engage with one or other lug 13 to cause the slide 9 to slide (arrow F) against the opposing action of the spring 17, to drag the head 5 into the open position.

The description given heretofore constitutes the state of the art, and thus does not form part of the present invention, which relates to a catch device which when activated is arranged to prevent sliding (arrow F) of the slide 9.

Said device is formed by providing the slide 9 with a transverse bar 20 disposed adjacent to the core 18 on that side thereof which is opposite the arcuate sector 19, and in the immediate vicinity of the base wall of the box casing 2. A block 21 is fixed on to the inner face of the closure plate 15, and a plug 22 into which there is screwed a stem 23 with a control knob 24 is disposed slidably therein. By the action of a spring 26, a ball 25 acts on a notch 27 provided in the plug 22 in order to prevent this latter being able to move accidentally.

Figure 1:
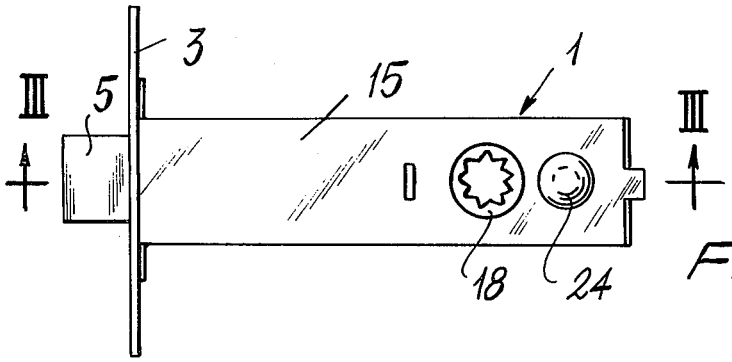
FIG. 1 is an overall plan view of the lock.
Figure 2:
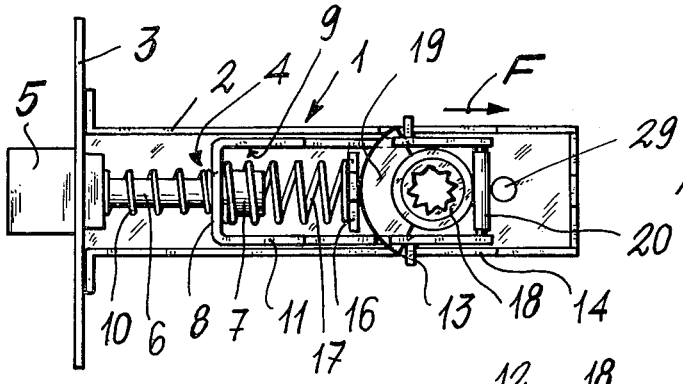
FIG. 2 is a plan view of the lock with the closure plate removed.
Figure 3:
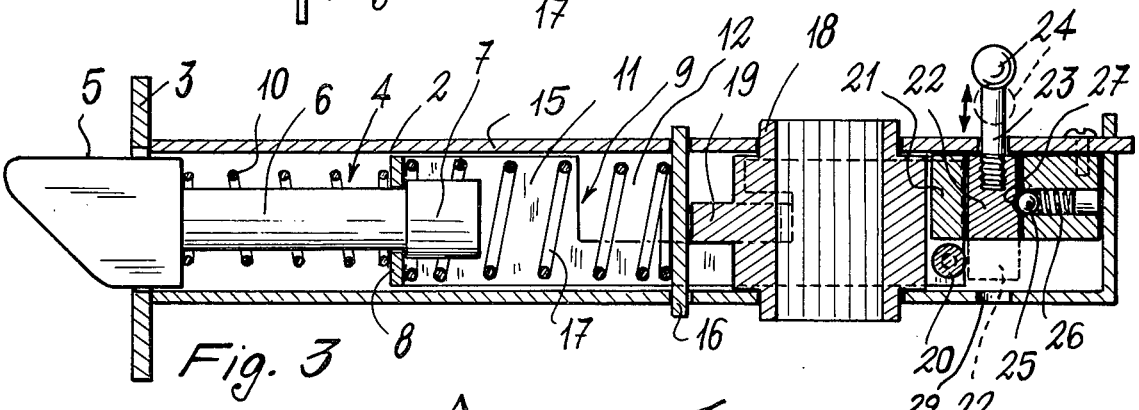
FIG. 3 is an enlarged section taken on the line III—III of FIG. 1, the catch device being illustrated in its active position by dashed lines and in its inactive position by full lines in said figure.

As can be seen in particular from FIG. 3, the block 21 is fixed on to the plate 15 in a position close to the core 18 in such a manner that when the plug 22 is in its active locking position illustrated with dashed lines, it is disposed in front of the bar 20 so as to prevent sliding (arrow F) of the slide 9, and to allow said sliding when it re-enters the block 21 and is engaged by the ball 25.

As illustrated diagrammatically in FIG. 4, the door 28 opens in the direction of the arrow G, and the catch device is mounted so that the knob 24 is facing the room A. In case of emergency, the catch device can be released from the room B by inserting any pointed tool into a bore 29 provided in the base wall of the casing 2 in alignment with the plug 22, so as to thrust said plug 22 into its disengaged position. The door 28 will obviously also be provided with a bore 32 aligned with said bore 29.

By rotating the head 5 through 180°, it is possible to mount the lock 1 on a door which opens in the opposite direction to the arrow G while still keeping the knob 24 in the room A, but it is also possible to locate said knob in room B by rotating the entire lock 1 through 180° about its longitudinal axis, and either rotating or not rotating the head 5 according to the direction of opening of the door.

From the aforegoing, it is apparent that the proposed design for the catch device enables the small standard dimensions of tubular locks to be respected, and also guarantees the required locking of the bolt 4 in a simple and rational manner.

What is claimed is:

1. In a lock, comprising a hollow casing, a sliding element disposed within said casing, said sliding element constituted by a front wall and two side walls, a bolt affixed to the front wall of said sliding element and adapted to extend and retract through an opening in said casing, a spring disposed about said bolt for biasing the same in an extended direction, two lugs, each disposed on a respective side wall of said sliding element, a second spring disposed within said sliding element and affixed to one end of said bolt, said second spring adapted to bias said bolt and said sliding element in the extended direction, a transverse element affixed to an end of said second spring opposite the end affixed to said bolt, and a control member for extending and retracting said sliding element and said bolt, said control member comprising a core extending through said hollow casing and adapted to receive a door handle, and an arcuate section disposed about said core, whereby when said core is rotated in one or another direction, said arcuate sector engages one or the other of said lugs to cause said sliding element to move against the biasing action of said second spring, and to retract the same and said bolt, the improvement comprising a transverse bar engaged with said side walls of said sliding element on a side of said core opposite said arcuate sector, a block affixed to an inner face of said casing, a plug mounted within said block for movement between first and second positions, said plug disposed to contact said transverse bar in said first position to retain the same in position, and to permit movement of said transverse bar and of said sliding element in said second position, a stem affixed at one end to an end of said plug and extending through an opening in said casing, a knob affixed to the other end of said stem, said stem and knob adapted to control position of said plug between said first and second positions, a bore disposed in said casing and substantially aligned with an end of said plug opposite the end to which said stem is affixed, said bore adapted to receive an implement for removing said plug from the first position, an indentation disposed in a side of said plug, and a ball and spring arrangement disposed within said block to be substantially aligned with the direction of extension and retraction of said bolt and sliding element, and adapted to contact said indentation in the side of said plug to retain the same in the second position.

* * * * *